US005539418A

United States Patent [19]

Egashira et al.

[11] Patent Number: 5,539,418

[45] Date of Patent: Jul. 23, 1996

[54] BROAD BAND MOBILE TELEPHONE ANTENNA

[75] Inventors: Shigeru Egashira, Saga; Takuji Harada, Hiratsuka; Takashi Kido; Eiji Tezuka, both of Yokohama, all of Japan

[73] Assignee: Harada Industry Co., Ltd., Tokyo, Japan

[21] Appl. No.: 191,444

[22] Filed: Feb. 3, 1994

Related U.S. Application Data

[62] Division of Ser. No. 857,108, Mar. 24, 1992, abandoned, which is a continuation of Ser. No. 547,695, Jul. 2, 1990, abandoned.

[30] Foreign Application Priority Data

Jul. 6, 1989 [JP] Japan ..... 1-175075
Aug. 25, 1989 [JP] Japan ..... 1-219274

[51] Int. Cl.[6] ..... H01Q 1/32; H01Q 9/04

[52] U.S. Cl. ..... 343/712; 343/713; 343/725; 343/769; 343/789; 343/752; 343/830

[58] Field of Search ..... 343/700 MS, 713, 343/712, 752, 725, 828, 829, 830, 846, 769, 789, 785, 847, 848; H01Q 1/32, 9/04

[56] References Cited

U.S. PATENT DOCUMENTS

| | | | |
|---|---|---|---|
| 2,724,052 | 11/1955 | Boyer | 343/830 |
| 2,834,959 | 5/1958 | Dorne | 343/769 |
| 2,996,713 | 8/1961 | Boyer | 343/700 MS |
| 3,852,760 | 12/1974 | Reggia | 343/830 |
| 3,967,276 | 6/1976 | Goubau | 343/752 |
| 4,051,480 | 9/1977 | Reggia et al. | 343/830 |
| 4,160,976 | 7/1979 | Conroy | 343/700 MS |
| 4,229,744 | 10/1980 | Luedtke | 343/769 |
| 4,342,037 | 7/1982 | Dalby | 343/830 |
| 4,520,363 | 5/1985 | Wachspress et al. | 343/830 |
| 4,644,361 | 2/1987 | Yokoyama | 343/700 MS |
| 4,697,189 | 9/1987 | Ness | 343/700 MS |
| 4,724,443 | 2/1988 | Nyssen | 343/700 MS |
| 4,791,423 | 12/1988 | Yokoyama et al. | 343/700 MS |
| 4,821,040 | 4/1989 | Johnson et al. | 343/713 |
| 4,835,540 | 5/1989 | Haruyama | 343/700 MS |
| 4,835,541 | 5/1989 | Jonnson et al. | 343/713 |
| 4,879,563 | 11/1989 | Takeda et al. | 343/700 MS |
| 4,972,196 | 11/1990 | Mayes et al. | 343/700 MS |
| 5,124,714 | 6/1992 | Harada | 343/769 |

FOREIGN PATENT DOCUMENTS

| | | | |
|---|---|---|---|
| 0278070 | 11/1987 | European Pat. Off. . | |
| 732827 | 6/1955 | United Kingdom | 343/785 |
| 1387679 | 11/1972 | United Kingdom . | |

OTHER PUBLICATIONS

"The ARRL Antenna Book", Published by American Radio Relay League, Inc., Newington, Connecticut, 1974, title pages, pp. 66, 67.

*Primary Examiner*—Michael C. Wimer
*Attorney, Agent, or Firm*—Frishauf, Holtz, Goodman, Langer & Chick

[57] ABSTRACT

A broad band mobile telephone antenna comprises a first conductive circular plate and a second conductive circular plate. The first plate is located above and in parallel with the second plate. The diameter of the second plate is equal to or larger than that of the first plate. The second plate is used as a ground plate, is attached on a body of an automobile. A short-circuit rod, for matching an impedance between the first plate used as an antenna and a coaxial feeder cable for the antenna, is connected between the first and second plates. An upper end of a core rod is connected to the first plate at the substantial center thereof. A lower end of the core rod is extended toward an opening formed in the substantial center of the second plate. The opening is connected to a connector which is placed inside the automobile through an opening formed in the body. The connector connects the core rod and the coaxial cable which is connected to a transmitter/receiver of a mobile telephone system. The inner conductive wire of the coaxial cable is connected to the core rod and the outer conductive sheath is connected to the ground potential.

12 Claims, 10 Drawing Sheets

BROAD BAND MOBILE TELEPHONE ANTENNA

This application is a division of application Ser. No. 07/857,108, filed Mar. 24, 1992, (now abandoned), which is a continuation of Ser. No. 07/547,695, filed Jul. 2, 1990 (now abandoned).

BACKGROUND OF THE INVENTION

1. Field of the Invention

The present invention relates to a broad band mobile telephone antenna.

2. Description of the Related Art

The conventional broad band mobile telephone antenna includes a rod antenna and a planar antenna. The rod antenna must be made long to gain a desired sensitivity for a broad band. When the automobile provided with this rod antenna is housed into the garage or it is running on the road, therefore, the long rod antenna becomes an obstacle, contacting the entrance of the garage or the roadside trees. Further, when it is running on the rapid transmit highway, the rod antenna creates loud noise resisting the wind. Whereas, when the planar antenna is made completely flat, its gain is small, its directivity is toward the vertical direction and its sensitivity is low with respect to the electromagnetic waves transmitted from the horizontal direction.

SUMMARY OF THE INVENTION

The object of the present invention is therefore to provide a broad band mobile telephone antenna which is shorter than the conventional rod antenna and is higher in sensitivity in the horizontal direction than that of the conventional planar antenna.

According to the present invention, there is provided a broad band mobile telephone antenna comprising a conductive plate having a capacitance, a conductive rod connected, at one end, to a substantial center of the conductive plate and, at the other end, to a transmitter/receiver by a feeder, a conductive member connected to a ground potential and located under the conductive plate, and a short-circuit rod connected between the conductive plate and the conductive member for matching the impedance between the conductive plate and the feeder.

According to the present invention, since the conductive plate is connected to the top of the conductive rod, the height of the antenna is shorter than that of the conventional rod antenna and the sensitivity in the horizontal direction is higher than that of the conventional planar antenna.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 1:
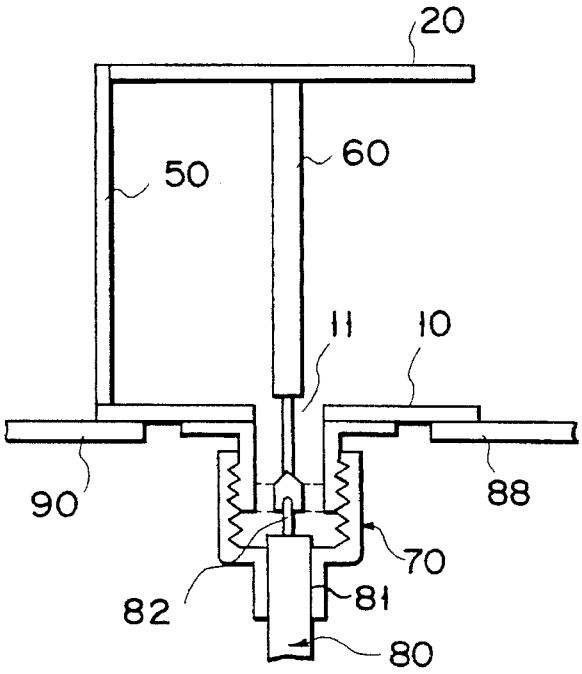
FIG. 1 is a front view showing a first embodiment of a broad band mobile telephone antenna according to the present invention.
Figure 2:
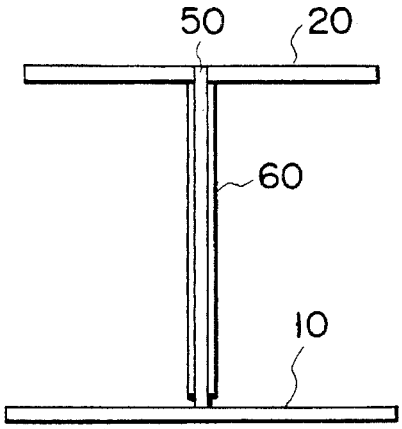
FIG. 2 is a left side view of the first embodiment.
Figure 3:
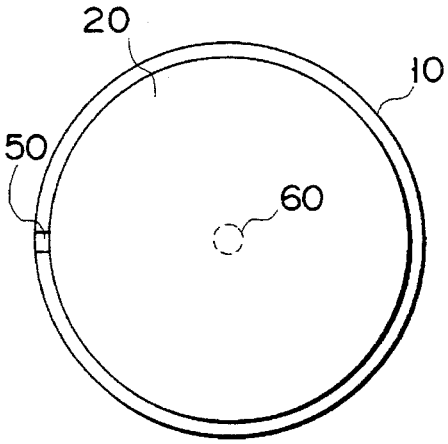
FIG. 3 is a plan view of the first embodiment.

A broad band mobile telephone antenna, which is a first embodiment of the present invention, will now be described with reference to the accompanying drawings. FIG. 1 is a front view of the first embodiment, FIG. 2 is a left side view of the first embodiment, and FIG. 3 is a plan view of the first embodiment. The first embodiment includes first and second conductive plates 20 and 10, both of which are formed substantially circular and arranged parallel to each other. The diameter of the lower plate 10 is equal to or larger than that of the upper plate 20. The lower plate 10, used as a ground plate, is attached on a body 88 of an automobile, such as a trunk lid. If the trunk lid 88 is formed of a conductive material, the trunk lid 88 may be used as the lower plate and the lower plate 10 may be omitted.

A short-circuit rod or conductive rod 50 (hereinafter called a short-circuit rod 50), for matching an impedance between the upper plate 20 used as an antenna and a feeder line for the antenna, is connected between the periphery portions of the plates 10 and 20. The upper end of the rod 50 is connected to the rim (peripheral portion) of the plate 20 and the lower end of the rod 50 is connected to an upper surface of the plate 10. An upper end of a core rod antenna 60 is connected to a lower surface of the plate 20 at the substantial center thereof. A lower end of the core rod antenna 60 is extended toward an opening 11 formed in the substantial center of the plate 10.

The opening 11 is connected to a connector 70 which is placed inside the body 88 of the automobile through an opening formed in the body 88. The connector 70 connects the lower end of the rod 60 and a coaxial cable (mobile telephone cable) 80 which is connected to a transmitter/receiver of a mobile telephone system (not shown). The coaxial cable 80 includes an inner conductive wire 82 and an outer conductive sheath 81. The top of the inner conductive wire 82 is connected to the lower end of the rod antenna 60 by the connector 70 and the outer conductive sheath 81 is connected to the ground potential by the connector 70.

The first embodiment having the above configuration is a combination of the rod antenna including the core rod antenna 60 and the planar antenna including the upper plate 20. Therefore, its elevational directivity is in a range of 20°, to 30°, and can be made smaller if the lower plate 10 is perfectly connected to the ground potential. The sensitivity in the horizontal direction is higher than that of the conventional planar antenna. The first embodiment is shorter than the conventional ¼ wavelength rod antenna for a broad band mobile telephone system, but the former can obtain a gain same as or larger than that of the conventional ¼ wavelength rod antenna.

Figure 4:
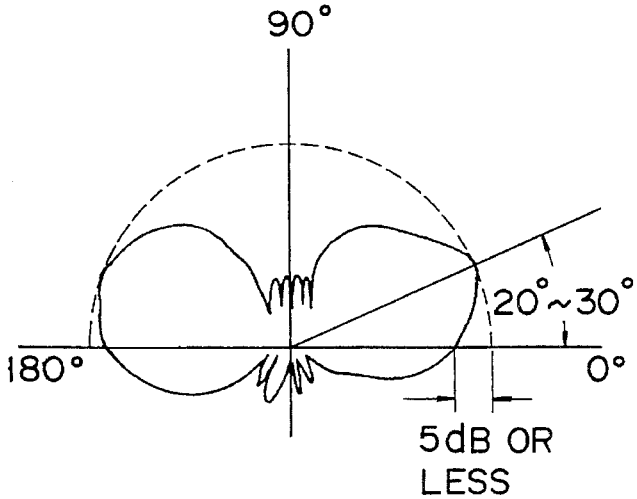
FIG. 4 shows the directivity of the first embodiment.

FIG. 4 shows the directivity of the first embodiment. As shown, its sensitivity drop from the maximum radiation in the horizontal direction is smaller than 5 dB.

Figure 5:
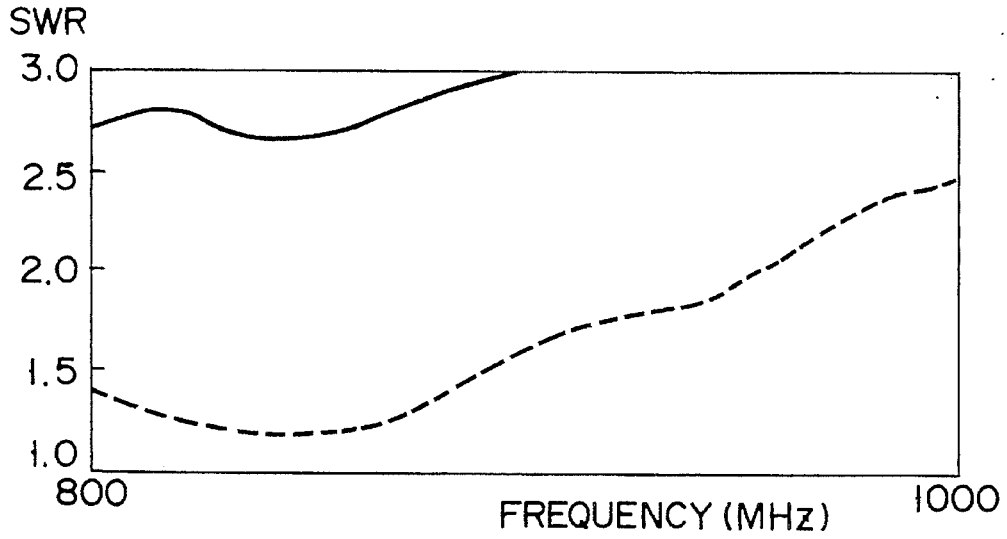
FIG. 5 is a graph showing a standing wave ratio (SWR) of the first embodiment.

In the first embodiment, the uniformity of its horizontal directivity is excellent (about 1 dB) and its standing wave ratio (SWR) is shown in FIG. 5. FIG. 5 shows characteristics of the first embodiment wherein the upper plate 20 has a diameter of 50 mm, the lower plate 10 is separated by 40 mm from the upper plate 20, an enamel copper wire having a diameter of 1.6 mm is used as the short-circuit rod 50 and a brass rod having a diameter of 6 mm is used as the core rod 60. A broken line in FIG. 5 shows the characteristic of the antenna which uses the short-circuit rod 50 and a solid line in FIG. 5 shows the characteristic of the antenna which uses no rod 50.

Figure 21:
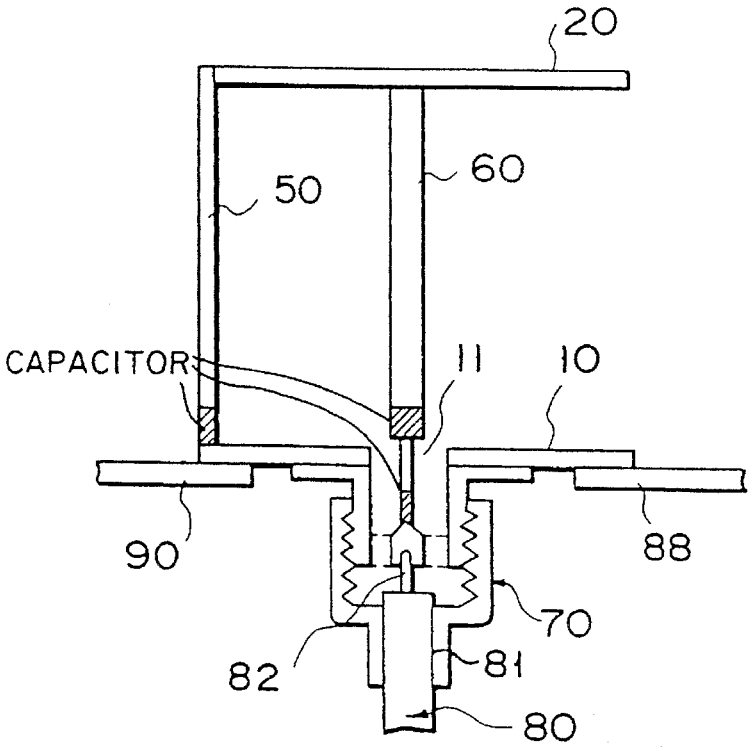
FIG. 21 is a front view showing a modification of the embodiment of FIG. 1.

When the short-circuit rod 50 is used for an impedance-matching, the real part component of the reactance becomes about 50 Ω over wide frequency band but the imaginary part component thereof remain a little. In order to compensate for the imaginary part component, a capacitor may be connected in series to the connector 70 or core rod 60, as shown in FIG. 21. Instead of connecting the capacitor to the core rod 60, the capacitor may be connected in series to the short-circuit rod 50, also as shown in FIG. 21.

A tuning frequency is determined by the diameter and the height of the core rod 60. When the tuning frequency is kept constant, the height of the whole antenna or the height from the lower plate 10 to the upper plate 20 can be made smaller as the areas of the plates 10 and 20 become larger.

It is possible to omit the connector 70, instead to connect the outer conductive sheath 81 of the coaxial cable 80 directly to the lower plate 10, and to connect the inner conductive wire 82 of the coaxial cable 80 directly to the core rod 60. In the embodiment, the plates 10 and 20 are shaped like a circle, but they may be shaped like an ellipse, rectangle or others. The plates 10 and 20 may be arranged eccentric to each other.

Figure 6:
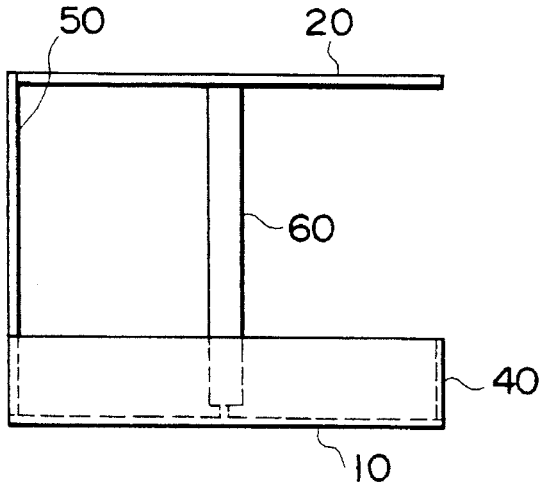
FIG. 6 is a front view of a second embodiment according to the present invention.
Figure 7:
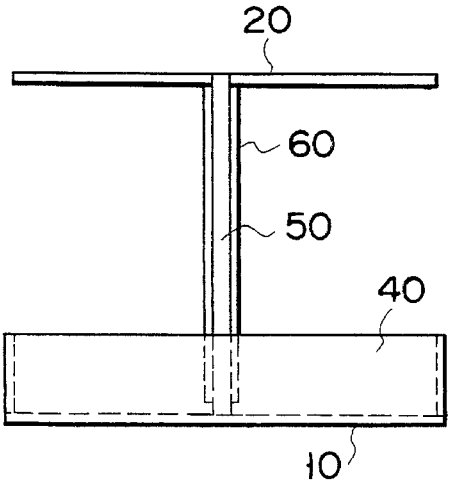
FIG. 7 is a left side view of the second embodiment.

FIGS. 6 and 7 show a second embodiment according to the present invention, in which FIG. 6 is a front view and FIG. 7 is a left side view of the antenna. The second embodiment differs from the first embodiment in that a cylindrical conductive member 40 covering the lower part of the antenna is connected to the lower plate 10. The cylindrical member 40 reduces a return loss of the antenna, which is a ratio of the power returning from the impedance mismatching portion to the power transmitted into the antenna, thereby matching with the coaxial cable 80 or the connector 70 and the antenna can be made more excellent and the height of the whole antenna can be made lower.

Figure 8:
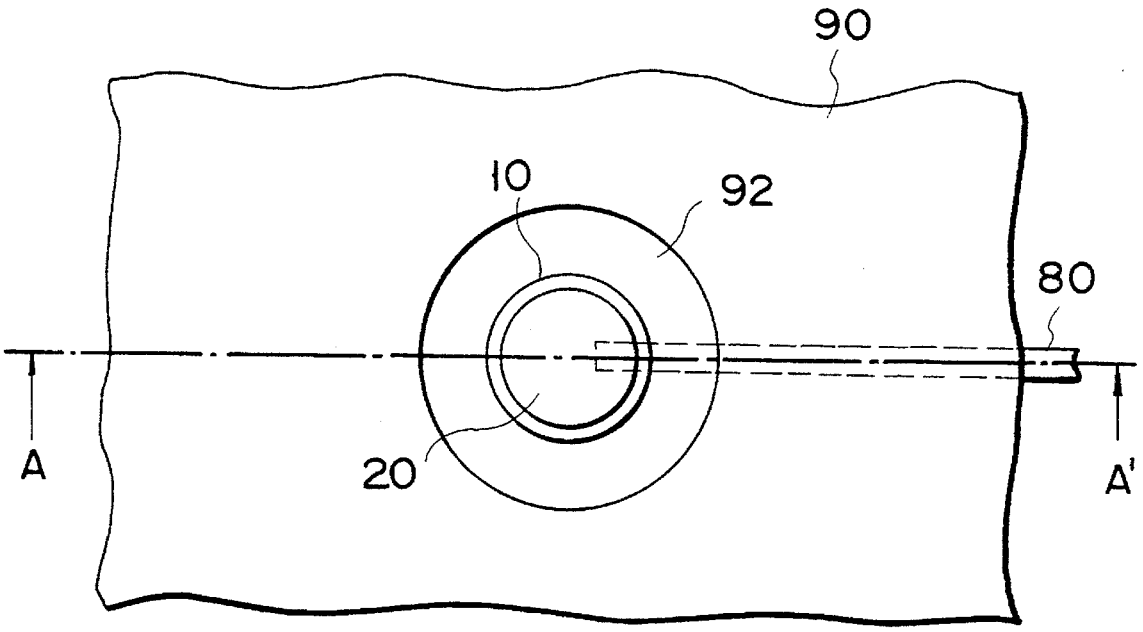
FIG. 8 is a plan view of a third embodiment according to the present invention.
Figure 9:
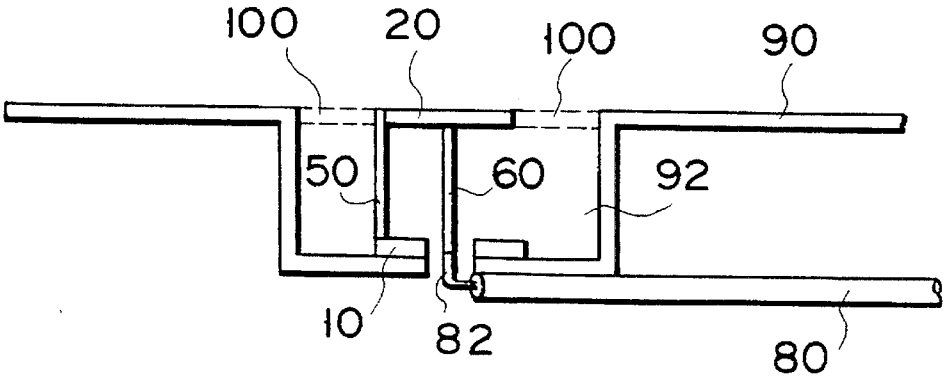
FIG. 9 is a cross sectional view of the third embodiment.

FIGS. 8 and 9 show a third embodiment according to the present invention, in which FIG. 8 is a plan view and FIG. 9 is a sectional view taken along a line A—A' in FIG. 8. The third embodiment is a modification of the first or second embodiment which relates to the arrangement of the antenna. A conductive plate 90 of a part of the body of the automobile, such as the trunk lid, has a recess 92 in which the antenna is placed. The antenna is located at the central portion of the recess 92. The depth of the recess 92 is equal to the height of the antenna and thus the upper plate 20 is held at same plane of the conductive plate 90. Therefore, an antenna, which is not projected outside the automobile body and thereby does not become an obstacle and does not create loud noise, can be easily realized. After the antenna is placed in the recess 92, the recess 92 is covered by a plate 100 formed of synthetic resin such as plastics which can keep electric wave loss small. The recess 92 is a circular shape and its diameter is 3 to 10 times larger than that of the plate 20. The shape of the recess 92 is not limited to the circle, but may be a rectangular or the like. The conductive plate 90 is cut off in a circular shape and the recess 92 is formed by a cylindrical wall plate and a circular bottom plate both of which may be formed of conductive material or nonconductive material. When the bottom plate is made of conductive material, an opening which corresponds to the opening 11 is formed in the center of the bottom plate and the lower plate 10 of the antenna may be omitted. In the third embodiment, the connector 70 is omitted and the coaxial cable 80 is connected directly to the antenna.

When the antenna using vertically polarized wave is embedded lower than the plane of the conductive plate 90 of the automobile, its directivity is remarkably toward the vertical direction and loss becomes large. It is not suitable, therefore, for the antenna for receiving electromagnetic wave transmitted from the substantially horizontal direction. However, when the antenna of the third embodiment is embedded in the recess 92 of the conductive plate 90 and the diameter of the recess 92 is set about 5 times larger than that of the antenna, its elevational directivity is not degraded but rather enhanced if the dimension of the recess relative to the antenna is appropriately selected.

Figure 10:
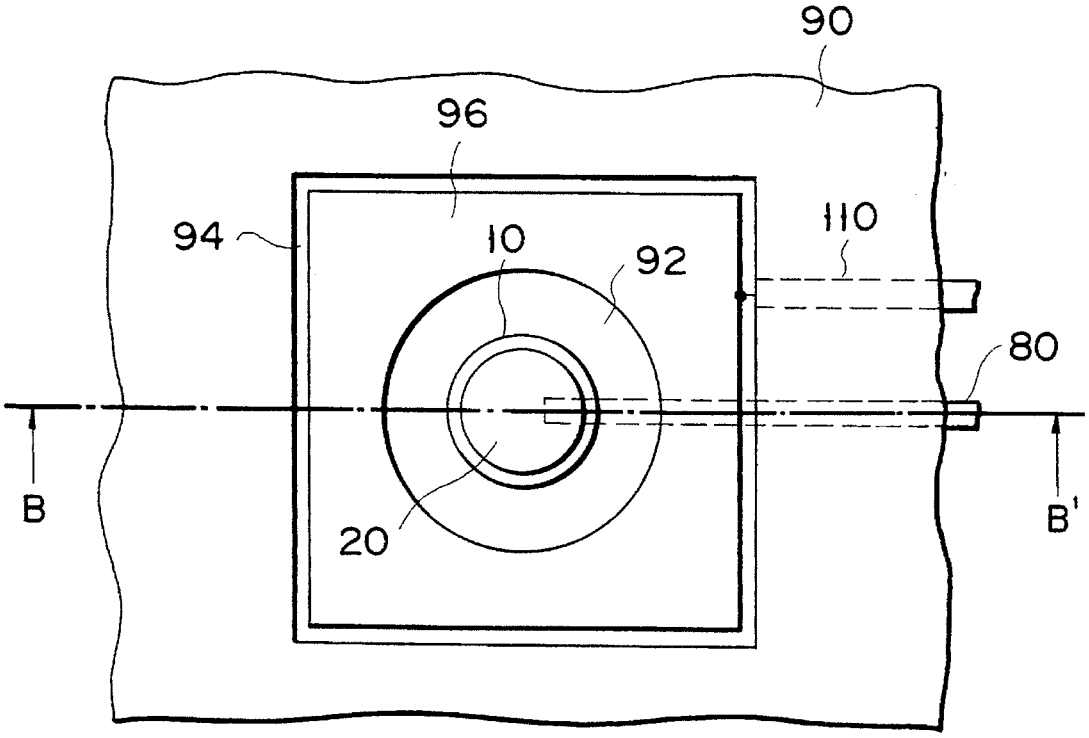
FIG. 10 is a plan view of a fourth embodiment according to the present invention.
Figure 11:
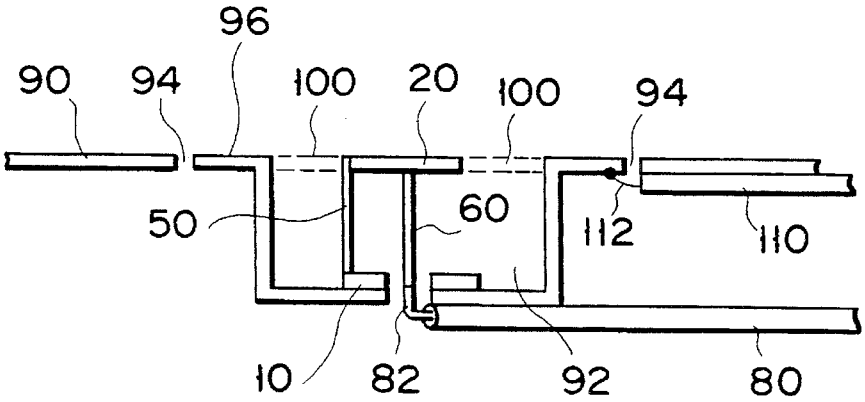
FIG. 11 is a cross sectional view of the fourth embodiment.

FIGS. 10 and 11 show a fourth embodiment according to the present invention, in which FIG. 10 is a plan view and FIG. 11 is a sectional view taken along a line B—B' in FIG. 10. The fourth embodiment differs from the third embodiment shown in FIGS. 8 and 9 in that the conductive plate 90 is provided with a closed slot 94. The conductive plate 90 is cut off in a rectangular shape to provide the closed slot 94 between the plate 90 and a center plate 96. The center metal 96 is supported by a nonconductive material such as resin. The recess 92 is formed in the center plate 96. The shape of the slot 94 is not limited to the rectangular, but may be a circle, a square, or the like. An inner conductive wire 112 of a coaxial cable 110 for a radio broadcast frequency band is connected to the edge portion of the center plate 96 and an outer conductive sheath of the coaxial cable 110 is connected to the conductive plate 90. The coaxial cable 80 is connected to the antenna in the same way as in the third embodiment shown in FIGS. 8 and 9.

The coaxial cable 110 serves to pick up signals at FM and AM radio broadcast bands and the coaxial cable 80 serves to pick up signals at a frequency band (900 MHz) for a mobile telephone system. The size of the closed slot 94 is about 1 m×0.7 m. The frequency band of the signals which are picked up by the coaxial cable 110 is not limited to the above value but must be lower than that of the signals which are picked up by the coaxial cable 80.

When signals are to be received by the closed slot 94, the coaxial cable 80 is set to be nonconductive. When signals are to be received by the antenna, the center plate 96 enclosed by the closed slot 94 is used as the ground plane for the antenna.

The coaxial cable 110 picks up signals at FM and AM radio broadcast bands. Because the frequency of the signal at the FM band is high, most of currents of the FM band flows through the peripheral portion of the center plate 96 and the signal at the FM band hardly flows through the center portion of the center plate 96. In other words, the center portion of the center plate 96 receives no influence with regard to the FM band. Therefore, the antenna of the present invention can be placed at the central portion of the center plate 96, and the signal of the mobile telephone system at a frequency band higher than the FM band can be picked up by the coaxial cable 80. The closed slot 94 works as a slot antenna intended to use concentrated current flowing through the slot 94 and the center plate 96 receives almost no influence to the signal of the mobile telephone system. This enables the center portion of the center plate 96 to be used as the ground plate of the slot antenna. Therefore, a multi-band mobile antenna of a small size can be realized.

Figure 12:
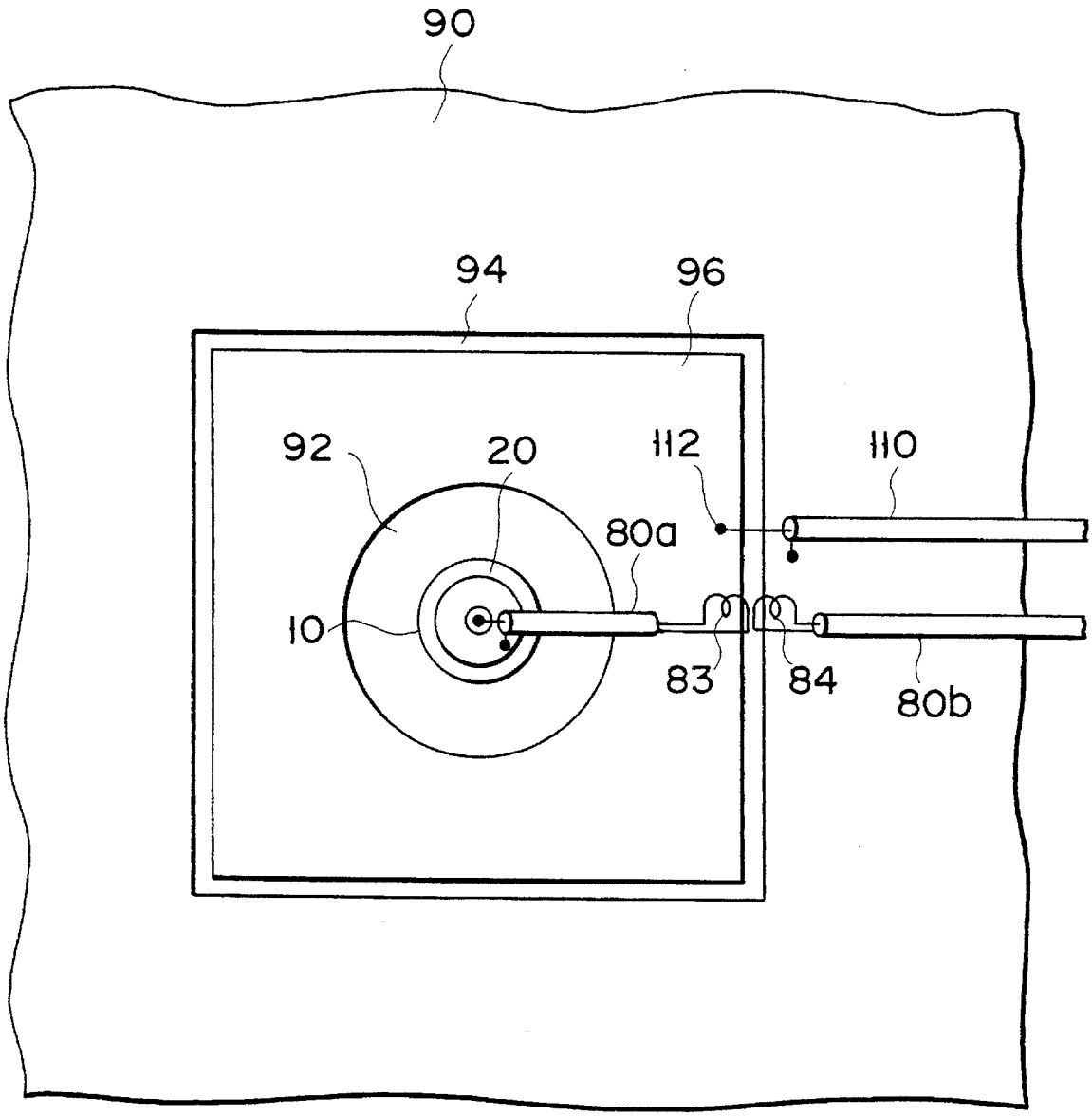
FIG. 12 is a plan view of a fifth embodiment according to the present invention.

FIG. 12 shows a plan view of a fifth embodiment according to the present invention. The fifth embodiment differs from the fourth embodiment in that the coaxial cable 80 for the mobile telephone system is comprised of two coaxial cables 80*a* and 80*b* and that these coaxial cables 80*a* and 80*b* are connected to each other by coils 83 and 84 by means of induction coupling.

When the coaxial cables 80*a* and 80*b* are induction-coupled by the coils 83 and 84 as shown in FIG. 9, loss of the signal at the AM frequency band picked up by the coaxial cable 110 is reduced. The signal at the AM frequency band is a capacitive antenna and it is excited by capacitance components connected between the coaxial cable and the ground. When stray capacitance components are present, therefore, the signal at the AM band is divided and lost by the capacitance components. The AM frequency band component picked up by the coaxial cable 110 is thus reduced. When the outer conductive sheath of the coaxial cable 80 and the conductive plate 90 are opposed to each other by a long distance as shown in FIGS. 10 and 11, large stray capacitance is caused between them. Therefore, signal component at the AM frequency band picked up by the coaxial cable 110 is reduced to a great extent by this stray capacitance.

However, when the coaxial cable 80 is comprised of two coaxial cables 80*a* and 80*b* and these coaxial cables 80*a* and 80*b* are induction-coupled by the coils 83 and 84 as shown in FIG. 12, the capacitance caused between the outer conductive sheath of the coaxial cable 80 and the conductive plate 90 is interrupted. In this case, the capacitance between the coils 83 and 84 is smaller than several pF. It is therefore extremely smaller as compared with the wavelength at the AM frequency band and loss at the AM frequency band is negligible.

It is preferable that the induction-coupling between the cables 83 and 84 is performed at the point located right under or above the closed slot 94. The loss is made the smallest in this case. The closed slot 94 in the above-described embodiments has a rectangular shape but when the corners of the center plate 94 are curved, efficiency can be increased. The antenna of the second embodiment may be used instead of the antenna in the third to fifth embodiments shown in FIGS. 8 to 12.

Figure 13:
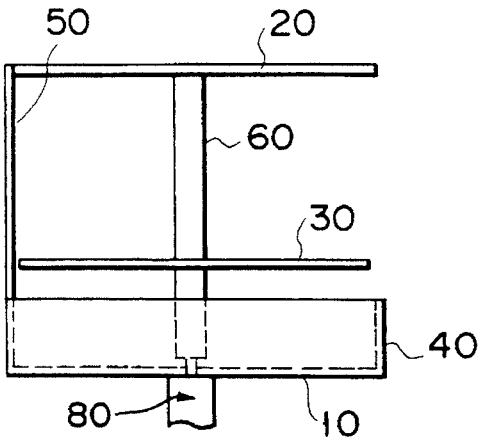
FIG. 13 is a front view showing a sixth embodiment according to the present invention.
Figure 14:
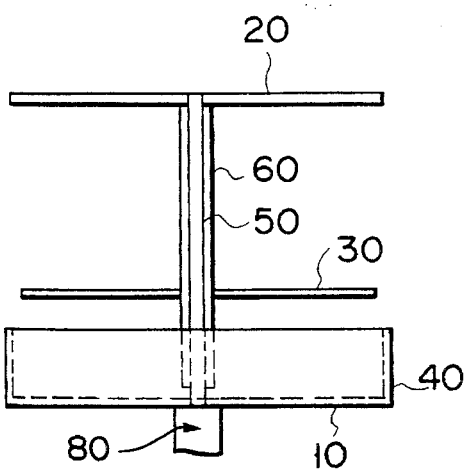
FIG. 14 is a left side view of the sixth embodiment.
Figure 15:
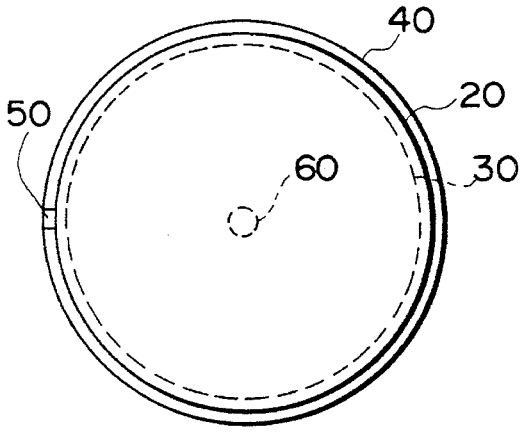
FIG. 15 is a plan view of the sixth embodiment.

FIGS. 13 to 15 show a sixth embodiment according to the present invention, in which FIG. 13 is a front view, FIG. 14 is a left side view, and FIG. 15 is a plan view. The sixth embodiment differs from the second embodiment in that a third conductive plate 30 used as a second planar antenna is located between the first and second conductive plates 20 and 10. The core rod 60 is also connected to the third conductive plate 30. The diameter of the intermediate circular plate 30 is slightly smaller than that of the upper plate 20. Therefore, the short-circuit rod 50 is not connected to the plate 30.

The elevational directivity is in a range of 20° to 30°, and can be made smaller if the lower plate 10 is perfectly connected to the ground potential. The sensitivity in the horizontal direction is higher than that of the conventional planar antenna. The sixth embodiment is shorter than the conventional ¼ wavelength rod antenna for a broad band mobile telephone system, but the former can obtain a gain same as or larger than that of the conventional ¼ wavelength rod antenna.

Figure 16:
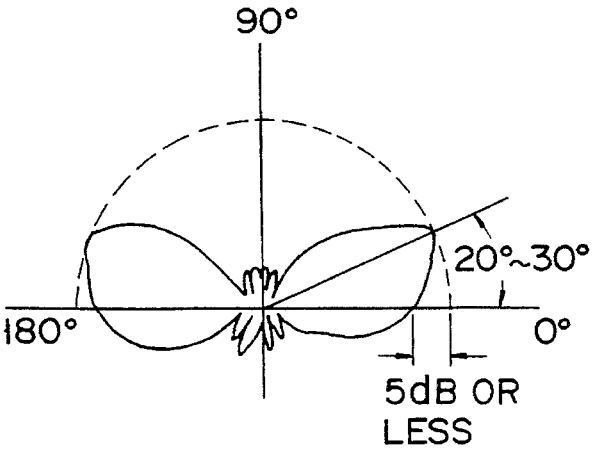
FIG. 16 shows the directivity of the sixth embodiment.

FIG. 16 shows the directivity of the sixth embodiment. As shown, its sensitivity drop from the maximum radiation in the horizontal direction is smaller than 5 dB.

Figure 17:
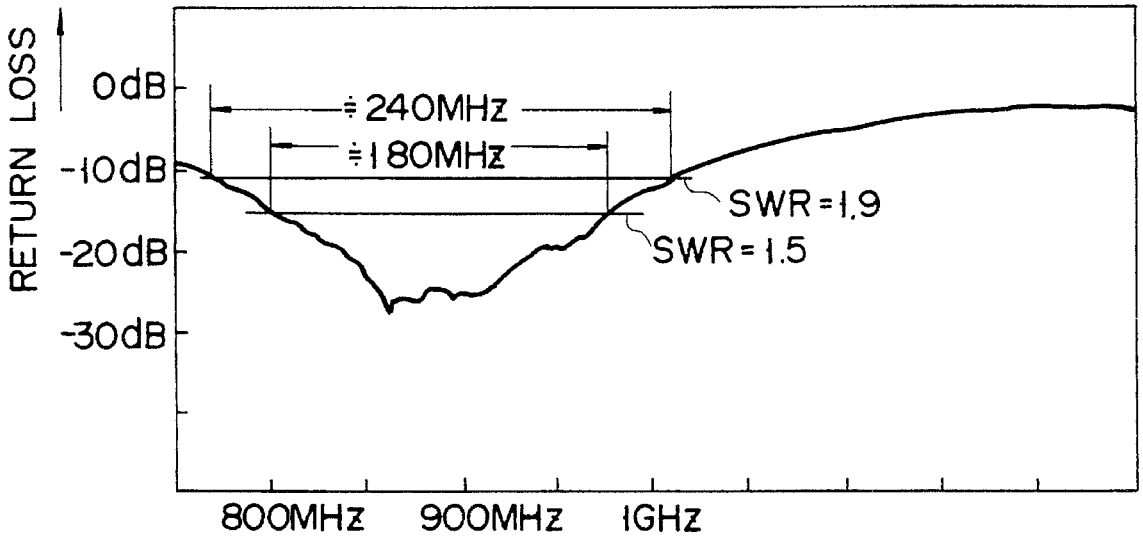
FIG. 17 is a graph representing a return loss of the sixth embodiment.

In the sixth embodiment, the uniformity of its horizontal directivity is excellent (about 1 dB) and its standing wave ratio (SWR) is shown in FIG. 17. As seen from FIG. 17, if the SWR is set to 1.5, the broad band (≈180 MHz) antenna can be realized with the center frequency of 900 MHz. FIG. 17 is obtained when the antenna is placed on a metal plate whose size is 380 mm×380 mm.

A tuning frequency is determined by the diameter and the height of the core rod 60. When the primary tuning frequency is kept constant, the height of the whole antenna or the height from the lower plate 10 to the upper plate 20 can be made smaller as the areas of the plates 10, 20, and 30 become larger. The primary tuning frequency can be also changed by changing the size of the plates 10 and 20.

According to the sixth embodiment, the double tuning antenna is realized by a first oscillator formed by the plates 30 and 10 and a second oscillator formed by the plates 20 and 30 if the size of the plates 10 and 20 and the height of the antenna are suitably determined. The double tuning makes the frequency characteristic of the SWR in a double peak curve and thus widens the frequency band of the antenna.

The cylindrical member 40 reduces a return loss of the antenna, which is a ratio of the power retiring from the impedance mismatching portion to the power transmitted into the antenna, thereby matching with the coaxial cable 80 or the connector 70 and the antenna can be made more excellent and the height of the whole antenna can be made lower.

Figure 18:
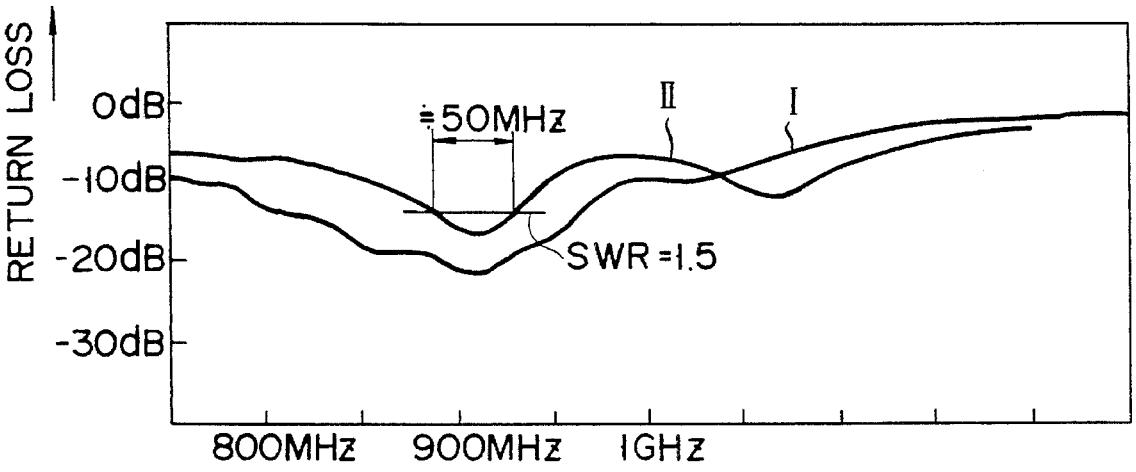
FIG. 18 is a graph showing a relationship between the return loss and the shape of the antenna of the sixth embodiment.

FIG. 18 shows the variation in the frequency characteristic when the position of the intermediate plate 30 is changed. If the plate 30 is slightly shifted upward with keeping the distance between plates 20 and 10 constant, as shown by the curve II, the secondary tuning frequency is shifted higher and the frequency band becomes approximately 50 MHz at the SWR=1.5. The curve I is the same as that shown in FIG. 17.

If the plate 10 is placed on the body of the automobile, the body must be provided with an opening through which the coaxial cable is connected to the core rod 60. The body of the automobile can be used as the plate 10 and the plate 10 can be omitted. In this case, the diameter of the cylindrical member 40 must be equal to that of the upper plate 20.

Though not shown in FIGS. 13 to 15, it is possible to connect the rod 60 and the coaxial cable 80 by the connector 70 as in the same manner in the first embodiment shown in FIGS. 1 to 3, or connect the outer conductive sheath 81 of the coaxial cable 80 directly to the lower plate 10 and to connect the inner conductive wire 82 of the coaxial cable 80 directly to the core rod 60.

In the sixth embodiment, the short-circuit rod 50 is not connected to the intermediate plate 30, however it may be connected to the plate 30 if the distances between the plates 10 and 30; 30 and 20; 10 and 20 and the diameters of the plates 10, 20, and 30 are suitably determined. The plates 10, 20, and 30 are shaped like a circle, but they may be shaped like an ellipse, rectangle or others. These plates 10, 20, and 30 may be arranged eccentric to each other.

The sixth embodiment can be modified in the same manner as in the previous embodiments, as should be apparent.

Figure 22:
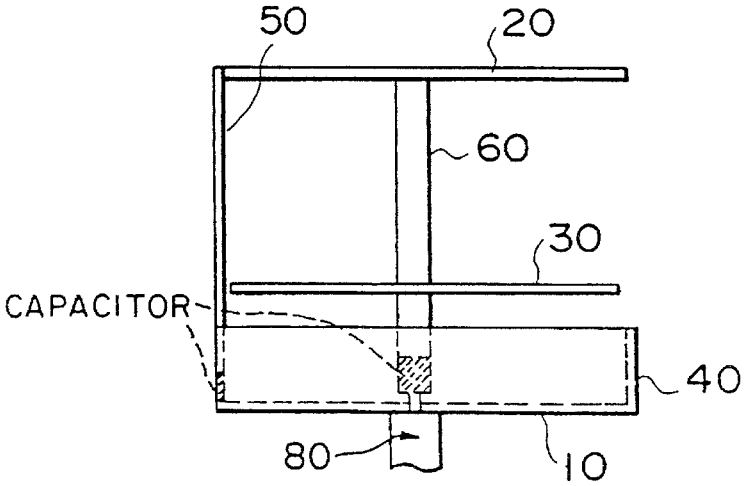
FIG. 22 is a front view showing a modification of the embodiment of FIG. 13.

For example, a capacitor may be connected in series to the coaxial cable 80, core rod 60, or short circuit rod 50, as shown in FIG. 22.

Figure 23:
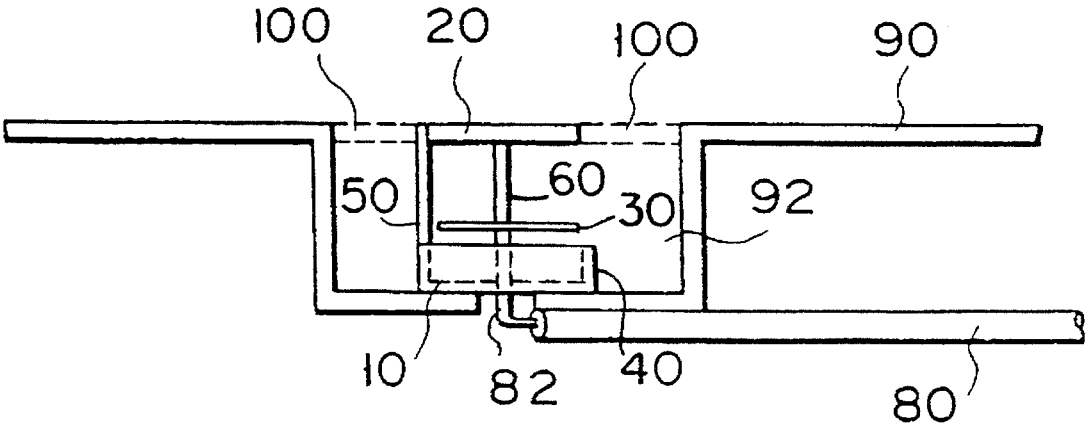
FIG. 23 is a cross-sectional view showing a modification of the embodiment of FIG. 9.

The antenna may be located in the recess 92 of the part of the automobile in the same manner as the third embodiment. FIG. 23 (similar to FIG. 9) is a sectional view taken along a line A—A' in FIG. 8, showing such an arrangement.

Figure 24:
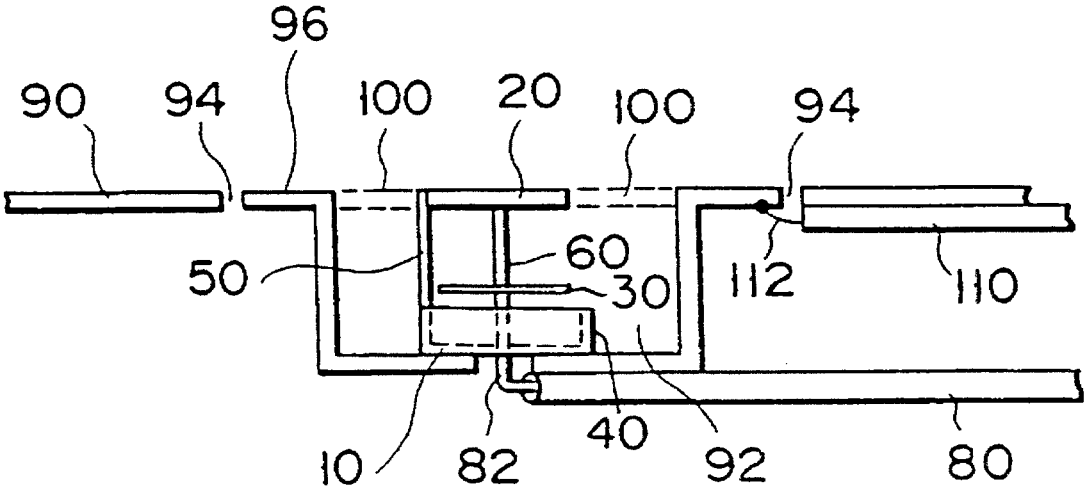
FIG. 24 is a cross-sectional view showing a modification of the embodiment of FIG. 11.

The antenna may be modified in the same manner as the fourth embodiment. FIG. 24 (similar to FIG. 11) is a sectional view taken along a line B—B' in FIG. 10, showing such a modification. In this modification, the antenna is provided in the closed slot 94.

The sixth embodiment (FIGS. 13–15) can also be modified in the same manner as the fifth embodiment (FIG. 12), in which the coaxial cable 80 is comprised of two coaxial cables 80*a* and 80*b* (FIG. 12) which are connected to each other by coils 83 and 84 by means of induction coupling (FIG. 12).

Figure 19:
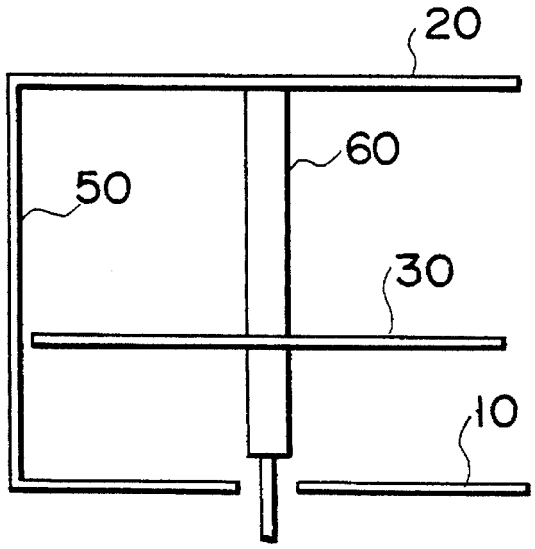
FIG. 19 is a front view of a seventh embodiment according to the present invention.
Figure 20:
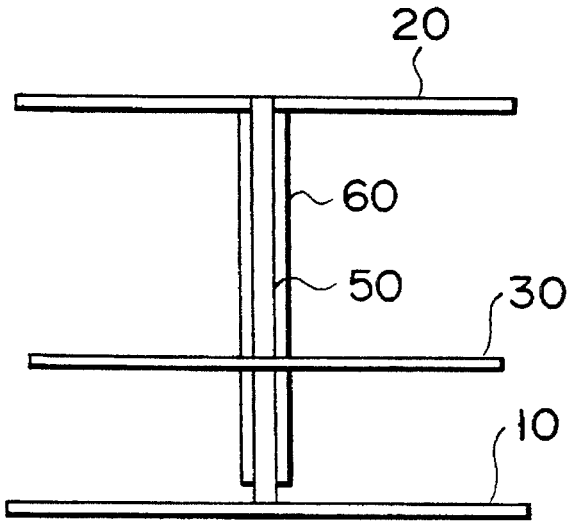
FIG. 20 is a left side view of the seventh embodiment.

FIGS. 19 and 20 shows a seventh embodiment according to the present invention, in which FIG. 19 is a front view and FIG. 20 is a left side view. The seventh embodiment differs from the sixth embodiment in that the cylindrical conductive member 40 covering the lower part of the antenna is omitted.

It is possible to replace the antenna placed in the recess of the third to fifth embodiments with the antenna according to the sixth or seventh embodiment.

This invention is not limited to the above embodiments, but can be modified in various manners without departing from the scope of the invention. For example, the second plate or the third plate can be formed of a planar mesh, net, or lattice.

According to the present invention, the broad band mobile telephone antenna can be made shorter than the conventional rod antenna for broad band automobile telephones, and have a gain suitable for practical use purposes and a higher sensitivity in the horizontal direction.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A broad band mobile telephone antenna comprising:

a first conductive plate;

a second conductive plate arranged parallel to said first conductive plate;

a conductive rod antenna arranged to radiate energy, said rod antenna having one end connected to and terminating at said first conductive plate substantially at an electrical center of said first conductive plate, such that said one end of said rod antenna does not protrude past said first conductive plate, said rod antenna further having an intermediate portion connected to said second conductive plate, and another end connected to a transmitter/receiver via a first feeder;

a third conductive plate connected to a ground potential and located under said second conductive plate; and a short-circuit rod, connected between said first conductive plate and said third conductive plate, for matching an impedance between said first conductive plate and said first feeder.

2. An antenna according to claim 1, wherein:

said first conductive plate comprises a first circular plate;

said second conductive plate comprises a second circular plate; and said third conductive plate comprises a third circular plate arranged parallel to said second circular plate.

3. An antenna according to claim 2, wherein:

said second circular plate has a diameter smaller than a diameter of said first circular plate; and said third circular plate has a diameter not smaller than the diameter of said first circular plate.

4. An antenna according to claim 1, wherein:

said short-circuit rod is connected to a rim of said first conductive plate at an upper end of said short-circuit rod and is connected to an upper surface of said third conductive plate at a lower end of said short-circuit rod.

5. An antenna according to claim 4, which further comprises a cylindrical member connected to a rim of said third conductive plate and extending toward said second conductive plate.

6. An antenna according to claim 1, which further comprises a capacitor connected in series with at least one of said conductive rod antenna and said short-circuit rod.

7. An antenna according to claim 1, wherein said third conductive plate is arranged in a recess formed in a body of an automobile, and a height of said conductive rod antenna is not greater than a depth of said recess.

8. An antenna according to claim 7, wherein said automobile body includes a closed slot surrounding said recess, and a second feeder for a radio broadcast signal.

9. An antenna according to claim 8, wherein said first feeder comprises two parts which are connected to each other by means of an induction-coupling.

10. An antenna according to claim 9, wherein said two parts are connected at a point in the closed slot.

11. An antenna according to claim 1, wherein said third conductive plate comprises a body portion of an automobile.

12. An antenna according to claim 1, wherein the number of conductive plates is limited to three.

* * * * *